United States Patent [19]

Awano et al.

[11] Patent Number: 4,808,374

[45] Date of Patent: Feb. 28, 1989

[54] METHOD FOR PRODUCING ALUMINUM ALLOY CASTINGS AND THE RESULTING PRODUCT

[75] Inventors: Yoji Awano; Yoshihiro Shimizu; Junichi Takabatake, all of Aichi, Japan

[73] Assignee: Kabushiki Kaisha Toyota Chuo Kenkyusho, Aichi, Japan

[21] Appl. No.: 945,241

[22] Filed: Dec. 22, 1986

Related U.S. Application Data

[63] Continuation of Ser. No. 612,946, May 23, 1984, abandoned.

[30] Foreign Application Priority Data

May 23, 1983 [JP] Japan ..... 58-90448
Feb. 9, 1984 [JP] Japan ..... 59-22401
Mar. 30, 1984 [JP] Japan ..... 59-64601

[51] Int. Cl.[4] ..... C22C 1/02

[52] U.S. Cl. ..... 420/537; 148/3; 148/159; 148/416; 148/417; 148/437; 148/438; 148/439; 420/534; 420/548

[58] Field of Search ..... 148/3, 13, 159, 415, 148/416, 417, 437, 438, 439; 420/534, 537, 548

[56] References Cited

U.S. PATENT DOCUMENTS 1,508,556 9/1924 Jeffries et al. ..... 148/3

*Primary Examiner*—R. Dean
*Attorney, Agent, or Firm*—Sughrue, Mion, Zinn, Macpeak & Seas

[57] ABSTRACT

A method for producing aluminum alloy castings and the resulting product having improved toughness. An Al-Si or Al-Si-Cu alloy containing 4 to 24 wt % of silicon, iron and other incidental impurities, the balance being aluminum is melted, and the melt is heated to a temperature between 780° C. and 950° C. The melt is poured into a mold and there solidified. A solution heat treatment and aging are then conducted. The process is suitable for an alloy containing 0.25 to 1.4 wt % of iron. In a preferred embodiment, the alloy consists essentially of 6 to 12 wt % Si, 2 wt % Cu, 0.2 to 0.4 wt % Mg and other incidental impurities, the balance being aluminum. The solution heat treatment is preferably carried out by heating between 525° 545° C. for a period of 1 to 5 hours.

14 Claims, 16 Drawing Sheets

(x200)

(x400)

(x200)

(x400)

(x200)

(x400)

(x200)

(x400)

AS CAST (x200)

HEATED AT 500°C FOR 5hr (x200)

HEATED AT 525°C FOR 3hr (x200)

HEATED AT 560°C FOR 5min, THEN LEFT TO COOL

HEATED AT 560°C FOR 5min, LEFT TO COOL, AND AGAIN HEATED AT 525°C FOR 3hr

HEATED AT 560°C FOR 30min, THEN LEFT TO COOL (x400)

(x400)

(x200)

(x200)

METHOD FOR PRODUCING ALUMINUM ALLOY CASTINGS AND THE RESULTING PRODUCT

This is a continuation of application Ser. No. 612,946, filed May 23, 1984, now abandoned.

BACKGROUND OF THE INVENTION

The present invention relates to a process for the production of aluminum alloy castings, especially of Al—Si and Al—Si—Cu alloy castings.

Conventionally, Al—Si alloy castngs having high toughness are produced from metals with minimum contents of impurities, especially of iron. Impurities present in metals cannot be removed without refining. Iron, which is one of the most problematic impurities that are easily introduced into metals, forms needles of an Al—Fe—Si compound, which not only reduces the toughness of the casting but also induces structural defects therein. Impurity iron is also introduced into the casting as a carryover from secondary metals (partially refined metals), scrap and return scraps. A method is known to alleviate the adverse effects of iron and provide a higher toughness by adding a suitable amount of manganese in order to crystallize the iron not as needles but as irregular-shaped particles of an Al—(Fe,Mn)—Si compound. However, even this method is not completely effective in eliminating the adverse effects of iron, and manganese added in an amount exceeding a certain level will impair the castability of the metal.

Aluminum alloy castings are subjected to a variety of thermal treatments. Among them is solution heat treatment wherein the alloy is heated to a high temperature to dissolve as much solute as practicable for ensuring a maximum result in the subsequent age hardening. Solution heat treatment also has the advantage of forming spherical eutectic Si particles in Al—Si alloys so as to increase their toughness.

While solution heat treatment is desirably effected at the highest possible temperature for the longest feasible period, it has been generally understood that in order to avoid "burning" that leads to a reduced strength, the temperature should not exceed the final solidification point of the casting in the nonequilibrium state. The period of solution heat treatment is also limited from cost and productivity viewpoints. As a result, not all of the solutes are put into solution in the matrix (solid solution of elements in aluminum) and some are left as crystals, and the eutectic Si particles are far from being spherical. Because of these facts, aluminum alloy castings are currently used without making the most of the inherent characteristics of the alloy.

SUMMARY OF THE INVENTION

Accordingly, one object of the present invention is to provide a process for producing an aluminum alloy casting having high toughness by minimizing the effects of iron impurities without the need for the addition of manganese or other elements and without sacrificing the castability of the alloy or the strength of the casting.

Another object of the present invention is to provide a process for producing an aluminum alloy casting having high toughness from a metal whose iron content is so large that needles detrimental toughness will unavoidably be formed if the casting is produced by the prior art method.

The conventional method of producing aluminum castings consists of melting a metal at a temperature about 750° C., subjecting the molten metal to necessary treatments such as deoxidation and degassing and pouring the melt into a mold to cast an ingot.

One aspect of the present invention concerns the melting step, and the above-mentioned objects are achieved by heating the molten metal at a temperature between 780° and 950° C., which is higher than the conventionally used temperature (about 750° C.). (This heat treatment is referred to as superheating treatment in the following description of the invention.) The method of the present invention according to its first aspect can be applied to the production of Al—Si alloy castings having a wide compositional range of 4 to 24% Si (all percents specified herein are by weight). The advantages of the present invention are appreciable in alloys having an undesired iron content of 0.25% or more. The invention is effective even at an iron content as high as about 1.4%.

As a result of various studies made to attain the above-stated objects, the present inventors have found that when an aluminum alloy containing a relatively small amount of iron (0.25 to 1.4%) is subjected to a superheating treatment according to the first aspect of the present invention, an iron compound is crystallized in the form of irregular-shaped particles having a small "notch" effect, whereas if a relatively large amount of iron is present, the iron compound is crystallized as needles but their size is very small. Therefore, irrespective of the iron content, an aluminum alloy casting having improved toughness can be produced by the present invention.

Another aspect of the present invention is directed to improving the strength and toughness, especially toughness, of an Al—Si—Cu alloy casting. As a result of various studies made to attain this object, the inventors have found that the object can be achieved by effecting the solution heat treatment of the casting at higher temperatures than those conventionally used in the production of Al—Si—Cu ternary alloy castings. According to this second aspect of the present invention, the casting is heated at a temperature not lower than its final solidification point but not higher than the solidus temperature or ternary eutectic temperature in the equilibrium state. As a result of this treatment, the solute element that has not gone into solution in the matrix nonequilibrium solidification is dissolved uniformly, and at the same time, the spheroidization of silicon crystals is accelerated to such an extent that an Al—Si—Cu alloy casting having better strength and toughness, especially high toughness, is obtained. The solution heat treatment according to the second aspect of the present invention is entirely free from the decrease in strength due to burning. As another advantage, the treatment period can be reduced without sacrificing the toughness of the casting.

A further aspect of the present invention is directed to a thermal treatment capable of producing an Al—Si—Cu alloy casting having improved toughness while retaining a high level of strength. According to this third aspect of the present invention, the Al—Si—Cu alloy after casting is heated at a temperature higher than the solidus temperature in the equilibrium phase diagram of the alloy for a period of time that will not produce a continuous band of liquid phase, thereby accelerating the change in the form of Si and other crystals in the casting. This heating is subsequently followed by solutiion heat treatment at a temperature below the solidus temperature but not lower than the solvus. As a result of this solutiion heat treatment, Si particles with sharp edges and corners acquire a relatively round shape, and at the same time solute elements such as Cu and Mg are put into uniform solution in the matrix. This treatment also causes the iron compound near the ternary eutectic to take on a granular form. Because of these phenomena, an Al—Si—Cu alloy casting having improved toughness can be manufactured without sacrificing its strength.

In order to ensure improved toughness, solution heat treatment according to the third aspect of the present invention is preferably effected at a temperature which is higher than the final solidification point of the casting but which is immediately below the solidus temperature. Again, this treatment will not cause a strength drop due to burning and the desired improvement in toughness can be obtained by a shorter period of treatment than previously required.

BRIEF DESCRIPTION OF THE DRAWINGS

FIGS. 8(A) and 8(B) are photomicrographs (at 400 magnification) showing the microstructure of an Al—Si—0.4% Fe alloy casting, wherein FIG. 8(A) shows the microstructure of a casting produced by the conventional method, and FIG. 8(B) shows the microstructure of a casting produced by the present invention;

FIGS. 11(A) and 11(B) are photomicrographs (at 200 magnification) showing the microstructure of an Al—6%Si—3.5%Cu—1.4%Fe alloy casting, wherein FIG. 11(A) shows the microstructure of a casting produced by the conventional method, and FIG. 11(B) shows the microstructure of a casting produced by the present invention;

DESCRIPTION OF THE PREFERRED EMBODIMENTS

Figure 1:
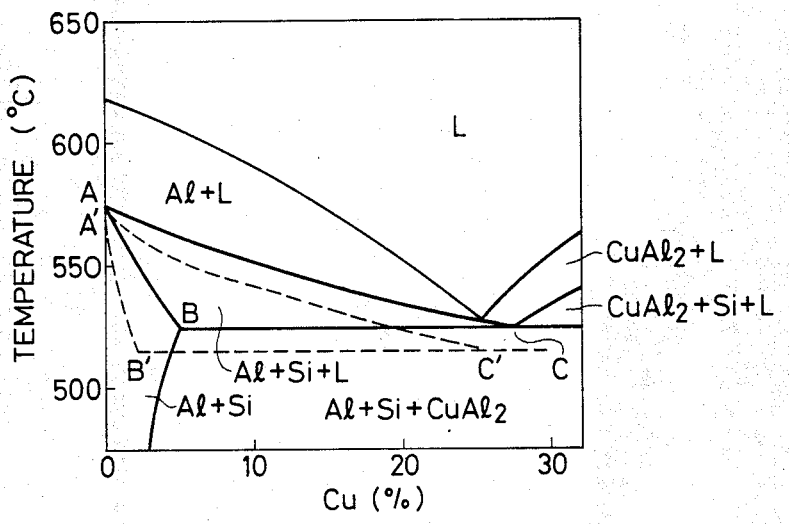
FIG. 1 is an Al—6%Si—Cu phase diagram which illustrates the second aspect of the method of the present invention.

The basic features of the solution heat treatment used in the method of the present invention are hereunder described by reference to FIG. 1, which is an Al—Si—Cu phase diagram taken for 6% Si. In FIG. 1, the solid lines show the solidus for the nonequilibrium state as determined from the cooling curve of an actual casting. As shown, the actual casting having a nonequilibrium state solidifies at temperatures lower than those required in the equilibrium state. Conventionally, in order to avoid burning, the alloy is solution heat treated at temperatures below the dashed line A'B'C'. However, in the equilibrium state, the temperature range above A'B'C' and below ABC is theoretically the region in which only the solid phase or Al+Si or Al+-Si+$CuAl_2$ prevails. Even if a small amount of liquid phase appears in the initial stage of solution heat treatment, the solute element in the liquid phase is gradually dissolved in the Al matrix as its diffusion proceeds, and finally, a product containing only a solid phase is obtained. Observation of the microstructure of an actually solidified casting shows that the last solidified portions of $CuAl_2$ are scattered about in the casting, and this suggests the possibility that burning due to a continuous band of liquid phase will not occur if solution heat treatment is effected in the temperature range defined by A'B'C' and ABC. Other advantages resulting from using this temperature range for solution heat treatment are that solutes such as Cu and Mg which serve as hardening elements can be put into solution in the matrix quickly and uniformly, and Si particles can be spheroidized rapidly. Both of these factors contribute to the production of a casting having an appreciably increased toughness.

Figure 2A:
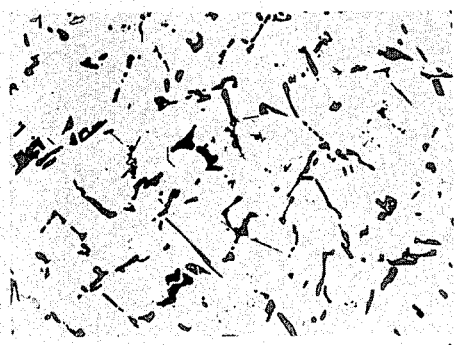
FIGS. 2(A) to 5(B) are photomicrographs showing the microstructure of an AC2B [Japanese Industrial Standard (JIS) H5202]alloy that was solution heat treated under various conditions (including those defined for the second aspect of the invention)
Figure 2B:
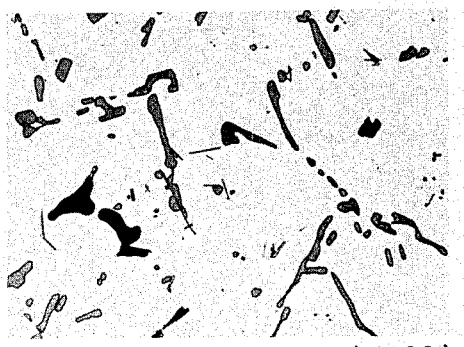

The microstructures of Al—6%Si—3.5%Cu—0.3%-Mg—0.25%Fe alloy samples that were subjected to T6 treatment (JIS H001, T6: solution heat treat and elevated temperature age) under varied conditions of solution heat treatment are shown in FIGS. 2(A) to 5(B), wherein the micrographs designated (A) have a magnification of 200 and those designated (B) are at 400 magnification. FIGS. 2(A) and 2 (B) show the microstructures of a sample that was solution heat treated at 500° C. for 5 hours; obviously $CuAl_2$ is left as clusters without being put into solution and Si particles are not as spherical as desired.

Figure 3A:
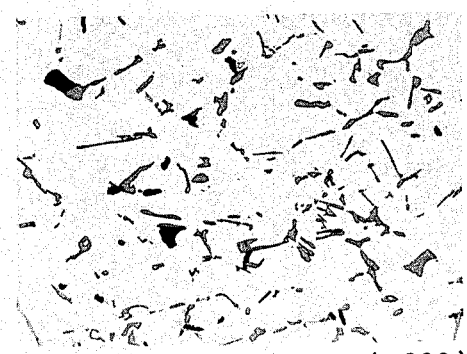
Figure 3B:
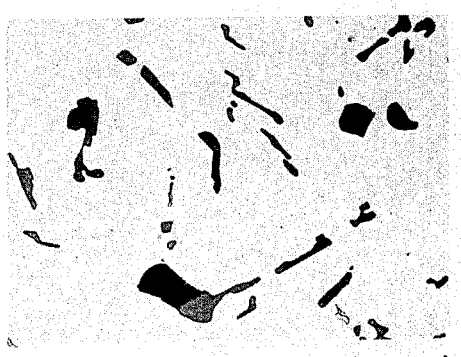

FIGS. 3(A) and 3(B) show the microstructure of a sample that was solution heat treated at 525° C. for 1 hour. As in FIGS. 2(A) and 2(B), some part of $CuAl_2$ remains undissolved, but its clusters are smaller and fewer than those formed by treatment at 500° C. Furthermore, the $CuAl_2$ clusters formed by the treatment at 525° C. were generally round and contained faceted Si that had grown in liquid phase. This would be explained as follows: upon heating at 525° C., the $CuAl_2$+Si+Al eutectic that was the last to solidify is melted, and as its diffusion proceeds, Cu is put into solution in the matrix, with the result that an Al—or Si-rich liquid phase forms, whereas Al grows on the matrix and Si on the already existing eutectic Si. If not all of the Cu present is put into solution in the matrix, the particles of Al—Si—$CuAl_2$ eutectic.

Figure 4A:
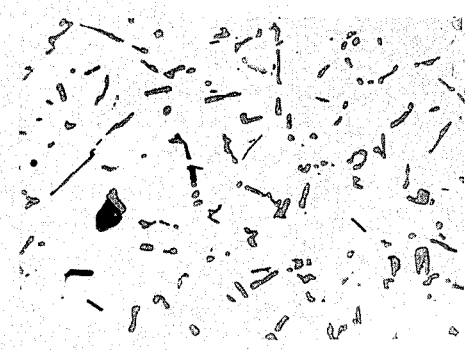
Figure 4B:
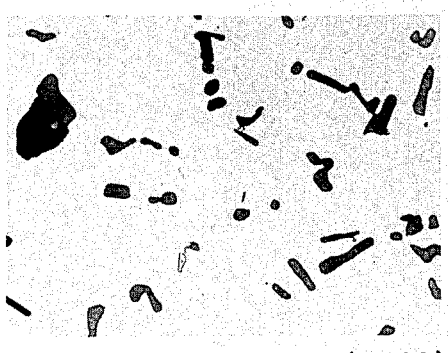

FIGS. 4(A) and 4(B) show the microstructure of a sample that was given solution heat treatment at 525° C. for 5 hours; the amount of residual $CuAl_2$ is reduced and the shape of Si particles is generally spherical.

Figure 5A:
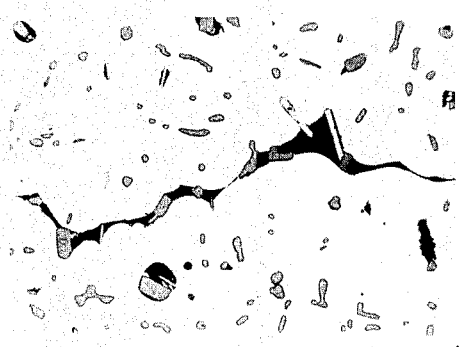
Figure 5B:
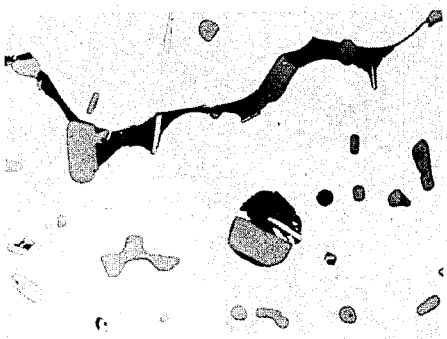

FIGS. 5(A) and 5(B) show the microsturcture of a sample that was solution heat treated at 535° C. for 5 hours; a band of liquid phase forms and the burning that occurs in that band reduces the impact strength and maximum load bearing capacity of the sample.

In the method of the present invention for producing an Al—Si—Cu alloy casting, the alloy that is subjected to the superheating treatment in the melting step is cast and the resulting casting may be solution heat treated according to the second aspect of the invention, namely, the casting is heated at a temperature not lower than the final solidification point of the casting and not higher than the solidus temperature or ternary eutectic temperature in the equilibrium state. In this particular embodiment, the Fe compound which would normally be crystallized as large needles is crystallized either as irregular-shaped particles or fine needles by means of the superheating treatment. In the subsequent solution heat treatment, an increased amount of Cu and Mg is put into solution in the matrix and the spheroidization of Si particles is promoted. Therefore, by combining the superheating treatment and the solution heat treatment according to the present invention, an Al—Si—Cu alloy casting having improved toughness can be obtained without sacrificing its strength.

Figure 6:
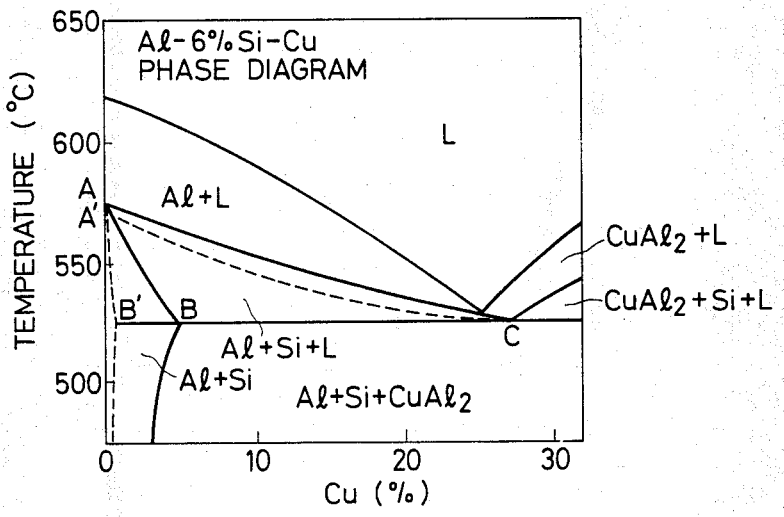
FIG. 6 is an Al—6%Si—Cu phase diagram which illustrates the operating theory of the third aspect of the method of the present invention.

The third aspect of the present invention, which is a modification of the basic solution heat treatment described above, is hereunder described by reference to FIG. 6, which is an Al—Si—Cu phase diagram taken for 6% Si. In FIG. 6, the dashed lines represent the solidus for Al—6%Si—Cu alloy in the nonequilibrium state as determined from the cooling curve of an actual casting. As shown, the actual casting undergoes nonequilibrium solidification which proceeds at temperatures lower than those required for solidification in the equilibrium state. Therefore, in order to avoid burning, the Al—Si—Cu alloy casting was solution heat treated in a temperature range not higher than the line A'B'C' indicating the final solidification temperature range.

It is generally understood that a solute element can be put into solution in the matrix most rapidly at the highest possible temperature not exceeding the line represented by ABC. Furthermore, crystals, especially eutectic Si particles that are crystallized as flaky crystals, undergo a favorable change in their shape in the highest possible temperature range that allows local contribution of a liquid phase. Observation of the microstructure of an actual casting containing as little as 0.5% Cu shows that, even in a region which would consist of only Al and Si in the equilibrium state, nonequilibrium solidification causes the crystallization of a $CuAl_2$ phase and the last solidified portions that are affected by this phase are scattered about in the casting. In addition, the concentration of a solute element (e.g. Cu or Mg) increases as it is closer to the last solidified portion. These observations permit the prediction of the profile of melting of a casting: as the temperature of the casting increases, the last solidified portion begins to melt first, and other areas melt in the order that their temperature exceeds the solidus temperature determined by the concentration of the solute present in each area.

On the basis of this prediction, the present inventors made the assumption that an Al—Si—Cu alloy casting having improved toughness can be produced by a two-stage solution heat treatment, wherein the casting is first heated at a temperature higher than the solidus temperature in the equilibrium state for a period of time that will not produce a continuous band of liquid phase, and the so heated casting is subsequently cooled. By the first stage of heating, the shape of crystals is changed, and by the subsequent cooling, the crystals are made generally spherical, and at the same time the solute elements are put into solution in the matrix.

Figure 7A:
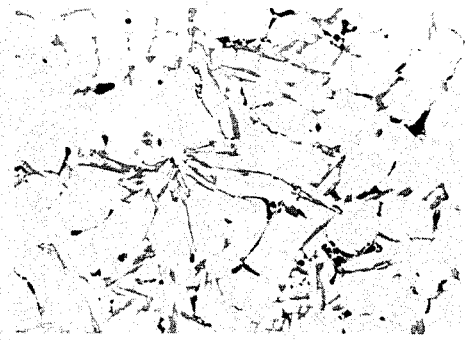
FIGS. 7(A) to 7(F) are photomicrographs supporting the theory illustrated in FIG. 6.
Figure 7B:
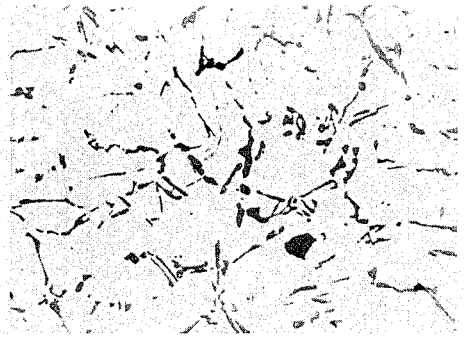

This assumption is theoretically supported by FIG. 7(B) to FIG. 7(F) which show the microsturctures of AC2B or Al—Si—3.5%Cu alloy casting samples that were solution heat-treated under various conditions. FIG. 7(A) shows the microstructure of a casting that was not given any post treatment. FIG. 7(B) shows the structure of a sample that was solution heat treated at 500° C. for 5 hours. The only difference from the as-cast sample of FIG. 7(A) is that gray flakes of eutectic Si are somewhat round at the corners. Most of the Al—Fe—Si compound produced was composed of a T2 compound in the form of pale gray needles having a high aspect ratio. Etching with Solutions A and B showed that black clusters of $CuAl_2$ were present in some areas without being put into solution in the matrix.

Figure 7C:
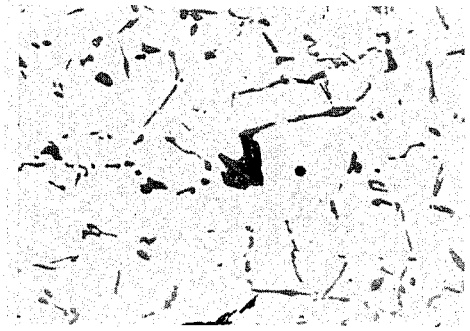

FIG. 7(C) shows the microstructure of a sample that was solution heat treated at 525° C. for 5 hours. Isolated areas consisting of generally round fine particles were found in this sample, and it is assumed that they were put into a liquid phase in the solution heat treatment. Faceted Si were present near the boundary of the liquid phase, but most of the eutectic Si phase was interrupted at several points, providing particles having a lower aspect ratio than the Si particles present in the sample that was solution heat treated at 500° C. for 5 hours. The compound containing Fe produced thick rods that were etched black with nitric acid.

Figure 7D:
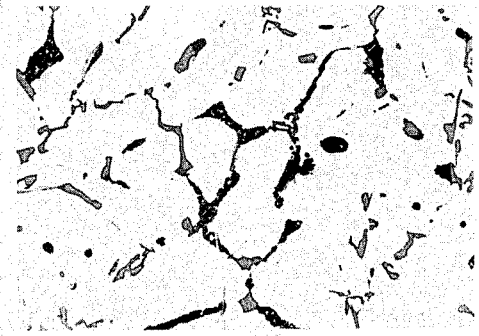

FIG. 7(D) shows the microsturcture of a casting sample that was first solution heat treated at 560° C. for 10 minutes and subsequently left to cool. Ternary eutectic portions that were affected by the $CuAl_2$ phase which had probably turned into a liquid phase in the heating period were found linked at several points, and faceted Si with sharp tips were present near these eutectic areas. The average size eutectic Si particles was relatively large, and their edges were not curved enough to approach a generally round shape. The compound containing Fe produced thick rods but they were not etched black with nitric acid.

Figure 7E:
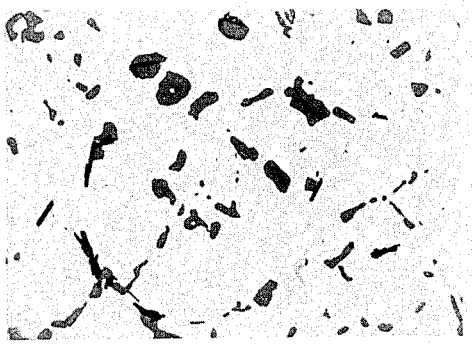

FIG. 7(E) shows the microstructure of a sample that was solution heat treated according to the third aspect of the present invention by first heating at 560° C for 10 minutes, then heating the same at 525° C. for 3 hours. By the first stage of heating, Si particles underwent a change in their shape, and by the second stage of heating, they acquired a generally round shape and the greater part of the $CuAl_2$ phase was put into solution in the matrix.

Figure 7F:
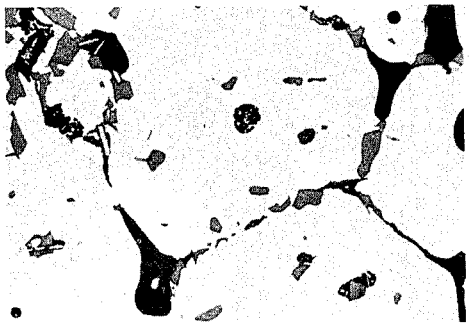

FIG. 7(F) shows the microstructure of a sample that was first heated at 560° C. for 30 minutes and then left to cool. A continuous band of liquid phase formed throughout the sample with large voids being present in several areas. Because of these defects, the sample had a low impact value and maximum load bearing capacity.

As shown above, according to the third aspect of the present invention, an Al—Si—Cu alloy casting is first heated at a temperature not lower than the solidus temperature in the equilibrium state so as to cause a rapid and great change in the shape of Si and other crystals in the casting. Then, the casting is held at a temperature lower than the solidus temperature but not lower than the solvus, preferably at a level just below the solidus temperature, thereby achieving an appreciable improvement in the toughness of the casting.

According to the third aspect of the present invention, an Al—Si—Cu alloy casting having improved toughness can be manufactured without sacrificing its strength, and in this respect the invention differs greatly from the prior art technique which aims at providing an improved toughness at the expense of casting strength by changing the alloy composition or the conditions of aging. The method of the present invention can be implemented very easily by simply controlling the temperature profile in the furnace in such a manner that temperatures not lower than the solidus temperature prevail in the initial period of heating and a temperature of about 500° C. is used immediately before quenching. As a further advantage, the period of solution heat treatment necessary for providing the desired toughness is shorter than is required in the prior art process.

The third aspect of the present invention may follow the melting step in the conventional process for producting an Al—Si—Cu alloy casting. If better results are desired, the molten metal is subjected to the superheating treatment according to the present invention, and after obtaining a casting from the molten metal, the casting is solution heat treated according to the third aspect of the present invention: the casting is first heated at a temperature not lower than the solidus temperature in the equilibrium state, and then the casting is cooled to a temperature lower than that solidus temperature but not lower than the solvus, preferably cooled to a temperature immediately below the solidus temperature, and the so cooled casting is subsequently held at that reduced temperature.

The present invention is shown in greater detail by reference to the Examples which follow, and it should be understood that these Examples are given here for illustrative purposes only and are by no means intended to limit the scope of the invention.

EXAMPLE 1

Two different alloy compositions, one being made of Al—6%Si—0.3%Mg—0.4%Fe (hereunder referred to as the first alloy) and the other made of Al—6%Si—3.5%Cu—0.4%Fe (the second alloy), were melted at 750° C. and castings were prepared therefrom. Another pair of the alloy compositions were given the superheating treatment according to the present invention (heated at 850° C.) and castings were made therefrom. A total of four casting samples were obtained. Without subjecting them to further treatments, these as-cast samples were checked for their bending impact strength. The results are shown in Table 1.

TABLE 1

| Alloy | Max. Temp. (°C.) | Impact Value (kg · m/cm$^2$) | Max. Load (kg) |
|---|---|---|---|
| (1) Al-6% Si-0.3% | 750 | 0.45 | 276 |
| Mg-0.4% Fe | 850 | 0.69 | 265 |
| (2) Al-6% Si-3.5% | 750 | 0.34 | 300 |
| Cu-0.4% Fe | 850 | 0.47 | 317 |

The test pieces were prepared by the following procedure. Pure aluminum was mixed with Al—12%Si, Al—10.7%Mg and Al—15%Fe to make two samples of the first alloy each having a total weight of 1.5 kg. Pure aluminum was also mixed with Al—12%Si, Al—34%Cu and Al—15%Fe to make two samples of the second alloy each having a total weight of 1.5 kg. Samples each of the first and second alloys was charged into an alumina-coated graphite crucible and melted in an electrical resistance furnace at 750° C., and subsequently deoxidized with a flux made of a 3:1 mixture of NaCl and $AlF_3$. Another sample each of the first and second alloys was treated in the same manner except that after it was melted, the temperature in the furnace was elevated to 850° C.

Each of the four melt samples was left to stand for 10 minutes until the melt became quiescent. After slag-off, the melt was immediately transferred into a vacuum furnace (750° C.) where it was degassed at 0.2 Torr for 20 minutes.

The melt was exposed to the open air and poured into a quartz sand shell mold at 700° C. to make a rod casting measuring 10 mm long, 10 mm wide and 130 mm high. The casting was cut into a length of 55 mm and a hole (2 mm ) was drilled in the center to prepare an as-cast notched test piece. The solidification time was about 40 seconds for the test pieces of the first alloy, and about 55 seconds for the test pieces of the second alloy.

As Table 1 shows, the samples of the first and second alloys that were prepared from the melt superheated to 850° C. had impact values that were about 40–50% higher than those of the samples made from the melt simply heated at 750° C. Nevertheless, little difference in the maximum load was observed between the two types of samples.

Figure 8A:
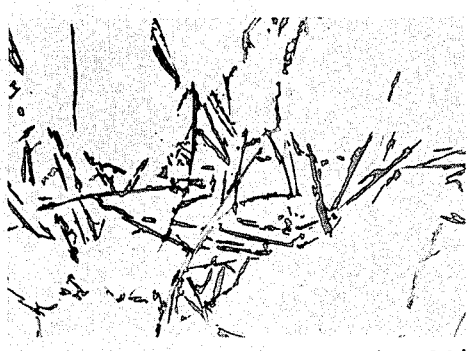
Figure 8B:
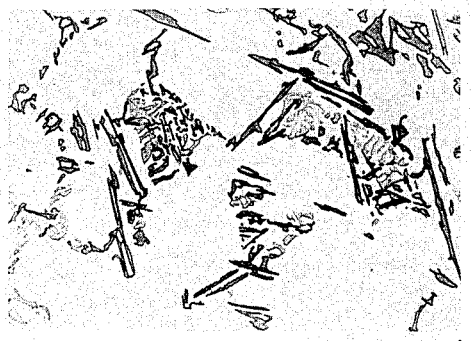

FIGS. 8(A) and 8(B) are optical micrographs showing at 400 magnification the microstructures of the casting two samples of the first alloy after solidification. FIG. 8(A) shows the sample that was prepared from the melt simply heated at 750° C., and FIG. 8(B) shows the sample prepared from the melt that was superheated to 850° C. In FIG. 8(A), impurity iron is crystallized as needles and almost all of the Fe is crystallized as irregular-shaped particles of Al—Fe—Si. Obviously, the improved toughness of the sample prepared from the melt that was superheated to 850° C. can be attributed to the microstructure of the casting that was modified to form irregular-shaped Al—Fe—Si particles rather than needles having a greater "notch" effect. It was confirmed by X-ray diffractiometry that the irregular-shaped particles as mentioned in this specification were made of an Al—Fe—Si compound that differed from the compound that was crystallized as needles. The same results were confirmed with the casting samples made from the second alloy; many needles of Al—Fe—Si were crystallized in the sample made from the melt that was simply heated at 750° C., but only a very small proportion of Fe needles was crystallized in the sample prepared from the melt that was superheated to 850° C. and almost all of the Al—Fe—Si particles crystallized had irregular shapes.

EXAMPLE 2

Figure 9:
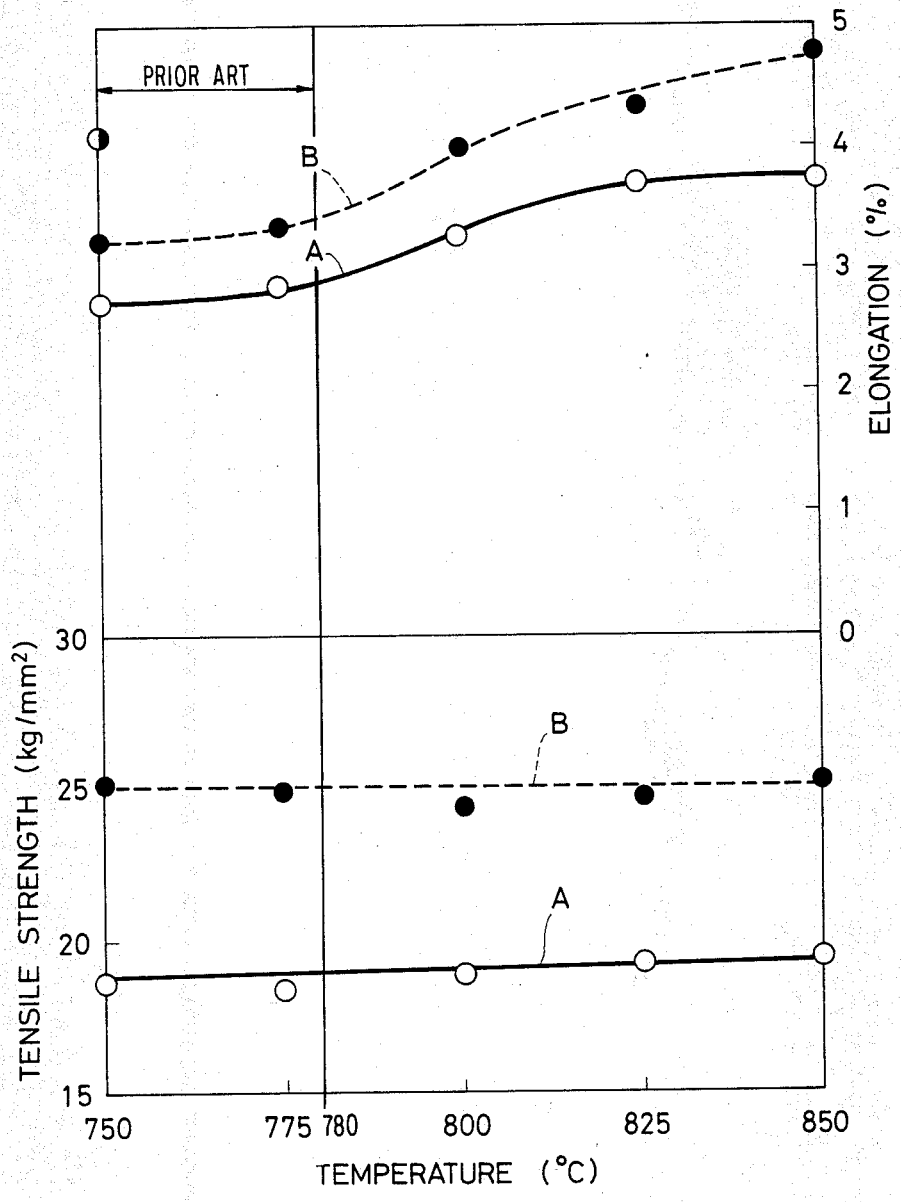
FIG. 9 is a graph showing the maximum melt temperature as against the tensile strength and elongation of alloy castings produced by the present invention and by the conventional method.

Two samples were cast from the second alloy composition and subjected to a tensile test. The relation of the tensile strength of each sample as against the maximum temperature of heating the melt is shown in the graph of FIG. 9. The shape of each test piece was in accordance with that of a proportional test piece JIS No. 7 that was prepared by simply solidifying the melt poured into a quartz sand shell mold. Each test piece had two parallel sides which were 15 mm apart and 8 mm thick. For details of the methods of melting the alloy and making a casting from the melt see Example 1.

One test piece was subjected to the tensile test in the as-cast state. The other piece was subjected to T6 treatment, which consisted of solution heat treatment at 500° C. for 5 hours, quenching in ice water, and immediately thereafter, aging the casting at 160° C. for 5 hours. The results of the test are shown in FIG. 9, wherein the lines A connecting open dots refer to the result with the as-cast sample and the lines B connecting solid dots indicate the result with the T6 treated sample.

As is clear from FIG. 9, the tensile strength of each sample was substantially the same even when the maximum temperature of heating the melt was changed from 750° to 850° C. However, a gradual increase in the elongation was observed at temperatures higher than 775°, and at 850° C. the difference was about, 30% for the as-cast sample and as much as about 50% for the T6 treated sample.

FIG. 9 also shows the elongation of a T6 treated casting that was prepared from an Al—6%Si—3.5%Cu—0.15%Fe alloy that was simply melted at 750° C. without superheating according to the present invention. The result is indicated by a semi-solid dot. Obviously, this control sample had an undesirably lower elongation than castings prepared from the melt that was superheated to 825° C. or higher according to the first aspect of the present invention.

These results of the tensile test were in good agreement with the observation of the microstructures of the respective solidified casting samples. The samples made of Al—6%Si—3.5%Cu, whether its Fe content was 0.25% or 0.4%, caused the crystallization of an Al—Fe—Si compound as needles when the alloy was simply melted at 750° C. without superheating. With a casting made of the Al—6%Si—3.5%Cu—0.4%Fe, an increasing proportion of the Al—Fe—Si compound was crystallized in irregular-shaped particles as the maximum temperature at which the melt was heated exceeded 750° C. by an increasing degree. At 850° C., only a very small proportion of the Al—Fe—Si compound was crystallized as needles and a major proportion of it was crystallized in irregular-shaped particles.

EXAMPLE 3

Figure 10:
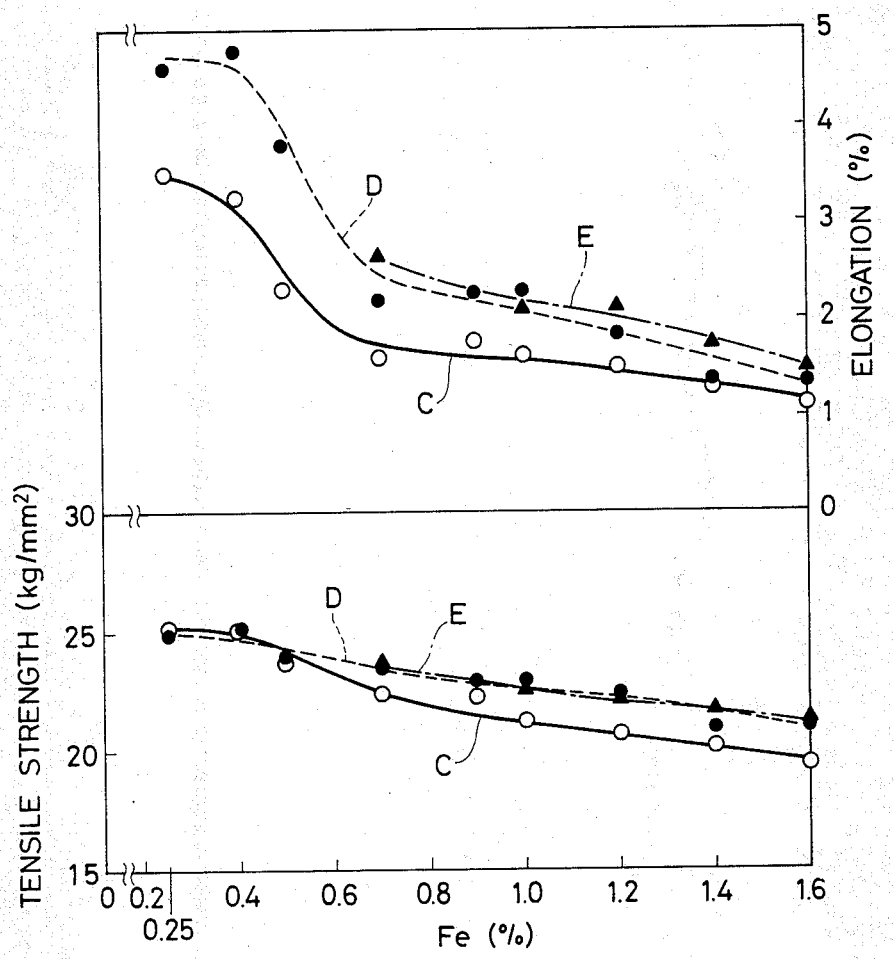
FIG. 10 is a graph showing the iron content vs. tensile strength and elongation of alloy castings produced by the present invention and the conventional method.

FIG. 10 shows the tensile of a T6 treated casting of Al—6%Si—3.5%Cu—Fe alloy whose Fe content was varied over the range of 0.25% to 1.6%. The respective samples were prepared from the melt that was simply heated at 750° C. (indicated by the lines D connecting solid dots), or at 950° C. (indicated by the lines E connecting solid triangles). For details of the methods of preparing the tensile test pieces and their solution heat treatment, see Example 2.

Compared with the samples made from the melt that was simply heated at 750° C. as in the prior art technique, those samples which were made from the melt superheated at either 850° C. or 950° C. had high elongation over the wide range of Fe content of from 0.25% to 1.6%, but the degree of improvement became smaller as the Fe content exceeded 1.4%, and at 1.6% Fe, the improvement was negligible. On the other hand, the tensile strength of the samples was not sacrified by the superheating treatment of the present invention.

Figure 11A:
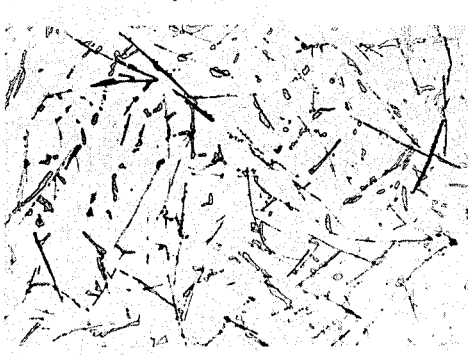
Figure 11B:
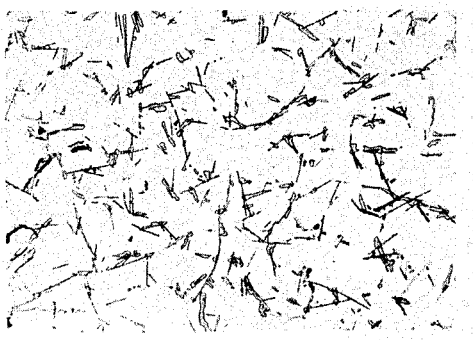

FIGS. 11(A) and 11(B) are optical micrographs showing at 200 magnification the microstructures of the two casting samples of an Al—6%Si—3.5%Cu—1.4%Fe alloy; FIG. 11(A) shows the sample that was prepared from the melt simply heated at 750° C., and FIG. 11(B) shows the sample prepared from the melt that was superheated to 950° C.

The Al—Fe—Si compound was crystallized as needles whether the melt from which the samples were made was heated at 750° C. or 950° C., but the needles crystallized in the samples cast from the melt that was superheated to 950° C. were apparently smaller in size. The needles crystallized in the samples cast from the melt that was simply heated at 750° C. were several times as large as the Si particles (which became roundish as a result of solution heat treatment) that were crystallized during eutectic solidification. However, the needles crystallized in the samples cast from the melt that was superheated to 950° C. were substantially as small as these eutectic Si particles.

As is also shown in Example 1, by superheating an Al—Si alloy to a temperature higher than 750° C. which is used in the conventional melting step, an Al—Fe—Si compound is crystallized as irregular-shaped particles if the Fe content is relatively small (about 0.4%), and if the Fe content is increased to about 0.6%, the Al—Fe—Si compound is crystallized both as fine needles and in irregular-shaped particles. In either case, the iron present as an impurity in the Al—Si alloy is crystallized not as needles but irregular-shaped particles having a smaller "notch" effect if the melt is superheated to a temperature higher than 750° C., and this contributes to the production of a casting having improved elongation.

As it demonstrated in Example 3, by performing the superheating treatment according to the first aspect of the present invention, a casting with improved elongation can be made from an Al—Si alloy having a larger content of iron. With this high Fe content, the Fe compound is crystallized as needles, but their size is so small as to contribute to producing improved elongation.

To summarize: the Al—Si alloy casting produced by the conventional method has significantly reduced toughness if it is made from a metal containing iron as an impurity. According to the first aspect of the present invention, a molten metal is superheated at a temperature between 780° and 950° C., which is higher than the conventionally used level (about 750° C.). By this superheating treatment, a casting having an appreciably improved toughness can be produced without sacrificing its strength properties. In the casting made from a melt that is treated by the prior art technique, the compound of impurity iron is crystallized as needles and these are responsible for the low toughness of the casting. However, by superheating the melt as shown above, the Fe compound is crystallized as irregular-shaped particles if the Fe content is relatively low, and if the Fe content is relatively high, the Fe compound is crystallized as needles, but their size is extremely small and thus contribute to the production of a casting having improved toughness without sacrificing its strength.

The method according to the first aspect of the present invention is capable of producing an Al-Si alloy casting having high reliability. Furthermore, the method enables the effective use of inexpensive metals having high Fe content and hence is belived to provide a greater economy in the manufacture of Al—Si alloy castings.

The advantages of the second aspect of the present invention, or the basic method of thermally treating a cast Al—Si alloy, are shown below by reference to Examples 4 to 7.

EXAMPLE 4

Figure 12A:
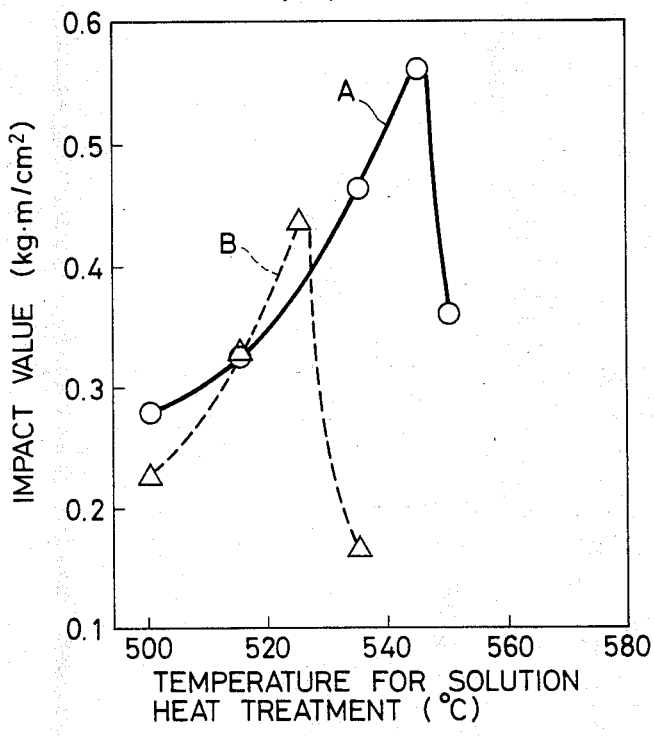
FIGS. 12(A) through 13(B) are graphs each showing the temperature for solution heat treatment vs. the impact value and maximum load bearing capacity of Al-6%Si-2%Cu alloy castings.
Figure 12B:
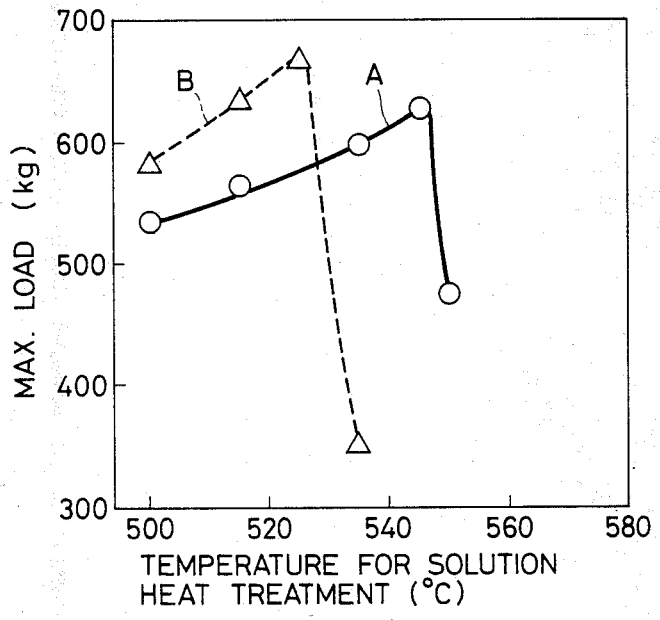

An AC2B alloy containing 6% Si and 2% Cu, as well as 0.3% Mg and 0.25% Fe impurities was melted at 750° C. as in the prior art technique, and poured into shell molds where it solidified in about 50 seconds. The so obtained casting samples were subjected to T6 treatment, wherein they were solution heat treated at various temperatures. The relation of the treating temperature and the impact bending strength of each sample is shown in FIGS. 12(A) and 12(B) by curves A. The samples were not given any special surface finishing for use as test pieces; they measured 10 mm×10 mm×55 mm and had a center notch in the form of a drilled hole of a diameter of 2 mm.

The final solidification temperature of the castings containing Mg as an impurity was 507° C., and in order to avoid burning, they would usually not be solution heat treated at temperatures higher than about 500° C. As shown in FIG. 12(A), the casting that was solution heat treated at 500° C. had an impact value of 0.28 kg·m/cm$^2$, but when the treating temperature was increased to 545° C. according to the present invention, the impact value was doubled to 0.56 kg·m/cm$^2$. There was no corresponding decrease in the maximum load bearing capacity, and instead a slight increase was observed as shown in FIG. 12(B). When the treating temperature was further increased to 550° C. or higher, a sudden drop occurred in both the impact value and maximum load bearing capacity.

FIG. 1 or the equilibrium phase diagram of Al—6% Si—Cu alloy shows that the alloy composition of the samples prepared in Example 4 had a solidus temperature of about 550° C. Therefore, the second aspect of the present invention is to solution heat treat a casting at a temperature not higher than its solidus temperature but not lower than its final solidification point. At temperatures higher than 550° C., both liquid and solid phases co-existed and the resulting "burning" caused deterioration of the castings. This was also confirmed by the presence of defects in their microstructures.

EXAMPLE 5

An AC2B alloy containing 6% Si, 3.5% Cu, as well as 0.3% Mg and 0.25% Fe impurities was melted at 750° C. as in the prior art technique, and poured into shell molds to make castings. The castings were then subjected to T6 treatment, wherein they were solution heat treated at various temperatures. The relation of the treating temperature and the bending impact strength of each sample is shown by the curves B in FIG. 12. The period of solution heat treatment, aging conditions and the size of test pieces were the same as used in Example 4.

The casting that was solution heat treated at 500° C. as in the prior art technique had an impact value of 0.23 kg·m/cm$^2$ and a maximum load bearing capacity of 580 kg. When the treating temperature was increased to 525° C. (just below the solidus temperature), the impact value was almost doubled to 0.44 kg·m/cm$^2$ and the maximum load bearing capacity also increased to 670 kg. However, these parameters for bending impact strength decreased when the treating temperature was elevated to 535° C. or higher.

EXAMPLE 6

Figure 13A:
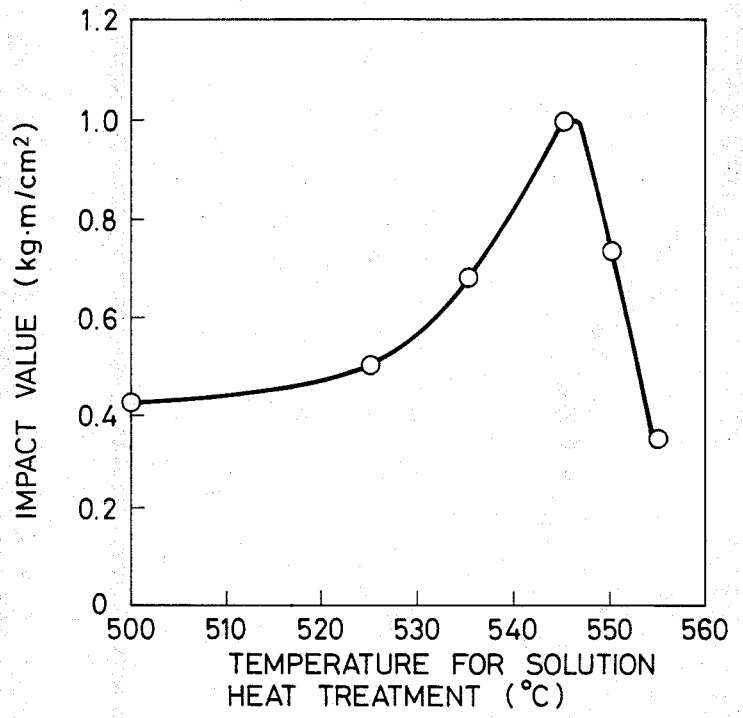
Figure 13B:
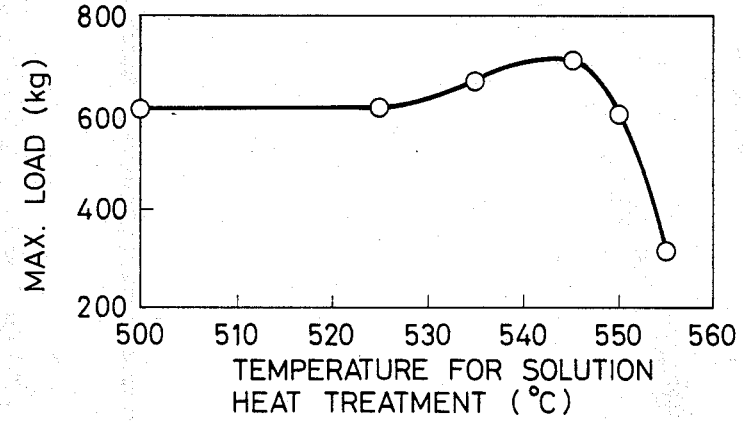

An AC2B alloy containing 6% Si and 2% Cu, as well as 0.3% Mg and 0.25% Fe impurities was melted at 850° C., poured into shell molds and solidified in about 50 seconds to crystallize the Fe compound as irregular-shaped particles. The so obtained casting samples were subjected to T6 treatment, wherein they were solution heat treated at various temperatures. The relation of the treating temperature as against the bending impact strength of each sample is shown in FIG. 13(A) and 13(B). The samples were not given any surface finishing for use as test pieces; they measured 10 mm×10 mm×55 mm and had a center notch in the form of a drilled hole (2 mmϕ).

The final solidification temperature of the castings containing Mg as an impurity was 507° C., and in order to avoid burning, they would usually not be solution heat treated at temperatures exceeding about 500° C. As shown in FIG. 13(A), the casting that was solution heat treated at 500° C. had an impact value of 0.43 kg·m/cm$^2$. But when the treating temperature was increased to 545° C. according to the present invention, the impact value was more than doubled to 1.0 kg·m/cm$^2$. There was no corresponding decrease in the maximum load bearing capacity, and instead, a slight increase occurred as shown in FIG. 13(B). When the treating temperature was further increased to 550° C. or higher, a sudden drop occurred in both the impact value and maximum load bearing capacity.

FIG. 1 or the equilibrium phase diagram of Al—6% Si—Cu alloy shows that the alloy composition of the samples prepared in Example 6 had a solidus temperature of about 550° C. Therefore, the second aspect of the present invention is to solution heat treat a casting at a temperature not higher than its solidus temperature but not lower than its final solidification point. At temperatures higher than 550° C., both liquid and solid phases coexisted and the resulting "burning" caused deterioration of the properties of the castings. This was also confirmed by the presence of defects in their microstructures.

Figure 14A:
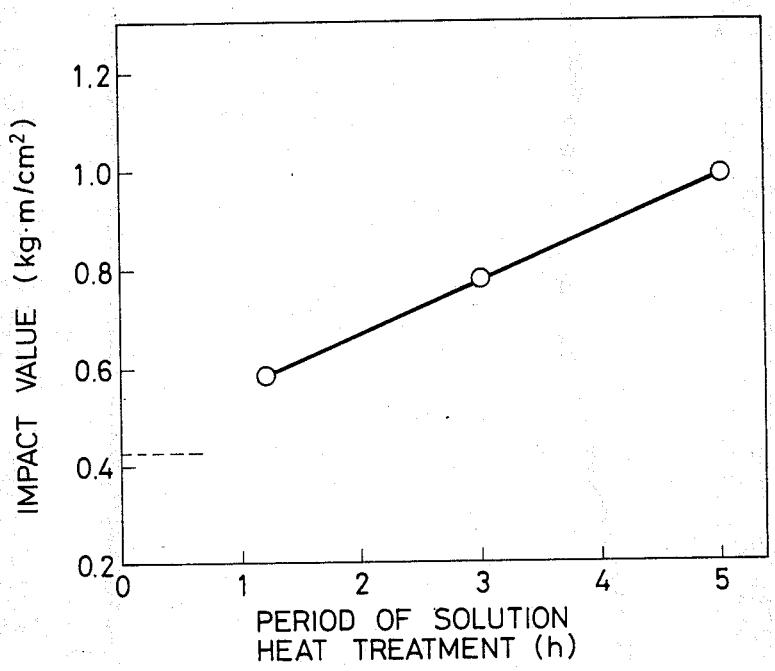
FIGS. 14(A) and 14(B) are graphs showing the period of solution heat treatment vs. the impact value and maximum load bearing capacity of Al—6%Si—2%Cu alloy castings.
Figure 14B:
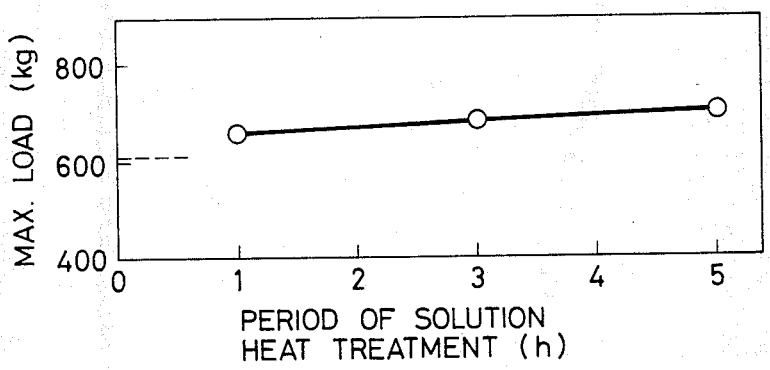

Castings were made from the same alloy composition as used above and they were subjected to T6 treatment consisting of solution heat treatment at 545° C. (as specified in the present invention) and aging at 160° C. for 5 hours. The period of solution heat treatment was varied from 1 to 5 hours to examine the relation of the treatment period as against the impact value and maximum load bearing capacity. The results are shown in FIGS. 14(A) and 14(B). A conventional casting that was solution heat treated at 500° C. for 5 hours had an impact value of 0.43 kg·m/cm$^2$ and a maximum load bearing capacity of 610 kg. The casting that was solution heat treated at 545° C. for 1 hour according to the present invention had an impact value of 0.59 kg·m/cm$^2$ and a maximum load bearing capacity of 660 kg. In other words, the solution heat treatment according to the second aspect of the present invention required only one hour to provide a casting having better properties than the conventionally treated casting. Much better results could be obtained by extending the period of this solution heat treatment.

EXAMPLE 7

Figure 15A:
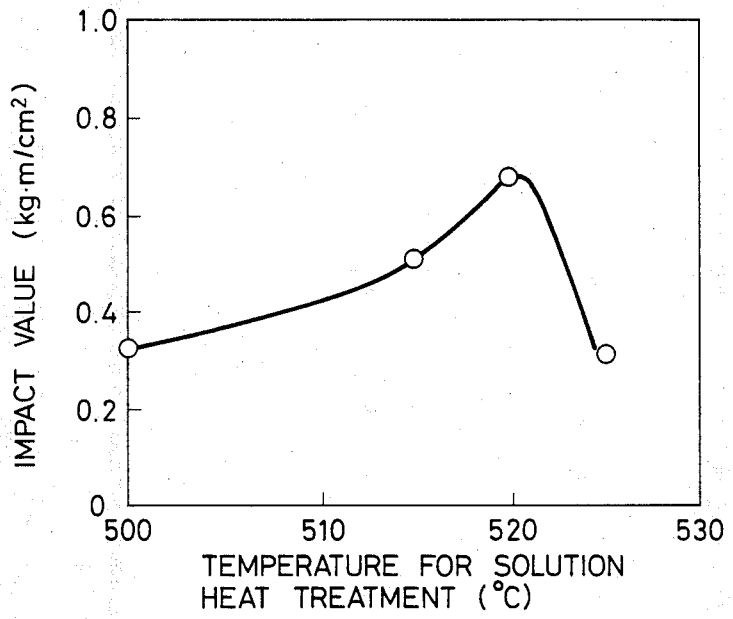
FIGS. 15(A) and 15(B) are graphs showing the temperature for solution heat treatment vs. the impact value and maximum load bearing capacity of Al—6%Si—4.5-%Cu alloy castings.
Figure 15B:
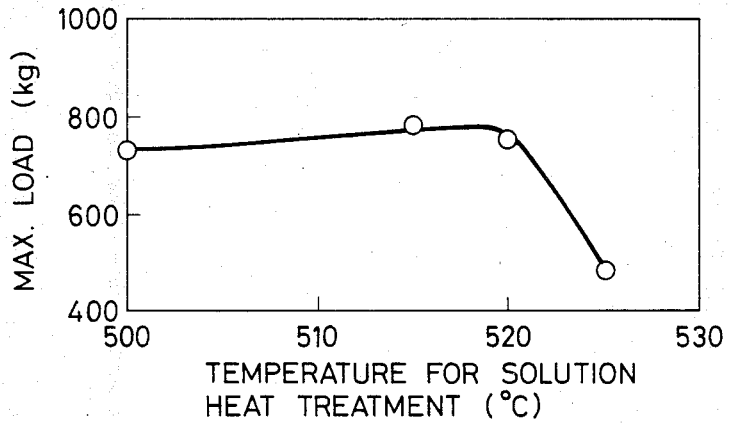

An AC2B alloy containing 6% Si, 4.5% Cu, as well as 0.3% Mg and 0.25% Fe impurities was melted at 850° C. and poured into shell molds to make castings wherein the Fe compound was crystallized as irregular-shaped particles. The castings were then subjected to T6 treatment, wherein they were solution heat treated at various temperatures. The relation of the treating temperature as against the bending impact strength properties of each sample is shown in FIGS. 15(A) and 15(B). The period of solution heat treatment, aging conditions and the size of test pieces were the same as in Example 4.

The casting that was solution heat treated at 500° C. as in the prior art technique had an impact value of 0.33kg·m/cm$^2$ and a maximum load bearing capacity of 730 kg. When the treating temperature was increased to 520° C., which was just below the ternary eutectic temperature of the alloy (about 525° C.), the impact value was more than doubled to 0.68kg·m/cm$^2$ and the maximum load bearing capacity also increased to 757 kg. However, these parameters for bending impact strength properties dropped to lower levels when the treating temperature was elevated to 520° C. or higher. These results are in good agreement with the phase diagram of Al—6%—Si—4.5%Cu having a solidus temperature of about 525° C. beyond which the alloy cannot be solution heat treated without causing "burning".

While Examples 4 to 7 have been given to show the advantages of the basic method of solution heat treatment according to the second aspect of the present invention, it should be understood that this method can be applied not only to the AC2B alloy castings having the compositions shown above, but also to all industrially used aluminum alloys containing 1.5–24% Si and 0.25–4.5% Cu.

To summarize: the conventional Al—Si—Cu alloy castings are solution heat treated at temperatures not higher than the final solidification point of each casting. According to the second aspect of the present invention, the solution heat treatment is basically performed at a temperature in the range of from the final solidification point up to the solidus temperature or ternary eutectic temperature in the equilibrium state. By using this basic method of solution heat treatment, a casting having improved strength and toughness (the improvement in toughness is particularly significant) can be produced without having defects due to burning. Furthermore, the desired effects can be obtained in a short period of solution heat treatment, and this will contribute to increasing the efficiency of the thermal treatments for Al—Si alloy castings.

The third aspect of the present invention is a modification of the basic method of solution heat treatment described above, and the advantages of this modification are hereunder described by reference to Examples 8 to 13.

EXAMPLE 8

An AC2B alloy containing 6% Si and 2% Cu, as well as 0.3% Mg and 0.25% Fe impurities was melted at 750° C., and poured into shell molds where it solidified in about 50 seconds. The so obtained casting samples were subjected to T6 treatment, wherein they were solution heat treated under various conditions and subsequently aged at 160° C. for 5 hours. The so treated samples were subjected to a bending impact test to determine the impact value and maximum load bearing capacity of each sample as plotted against the period of heating above the solidus temperature. The casting samples were not given any surface finishing for use as test pieces; they measured 10 mm×10 mm×55 mm and had a center notch in the form of a drilled hole of a diameter of 2 mm.

The final solidification temperature of the castings containing Mg and Fe as impurities was 507° C., and in order to avoid burning, they would usually not be solution heat treated at temperatures higher than about 500° C. The casting that was solution heat treated at 500° C. for 5 hours had an impact value of 0.28 kg·m/cm$^2$. According to the third aspect of the present invention, casting samples were first heated for various times at 555° C. higher than the solidus temperature, then left to cool to room temperature, again heated at 500° C. for 3 hours and aged at 160° C. for 5 hours. Also, samples were heated at 565° C. for various times and subsequently treated in a similar manner. The sample that was first heated at 555° C. for 1 hour had an impact value of 0.68 kg·m/cm$^2$, and the one that was heated at 565° C. for 10 minutes had an impact value of 0.55 kg·m/cm$^2$. A drop in the impact value was observed when the period of heating at 555° C. exceeded 1 hour. For heating at 565° C., a maximum impact value was obtained by heating for about 10 minutes, and a longer heating caused a significant drop in the impact value.

For heating 555° C., a peak of the maximum load bearing capacity was 593 kg, whereas for heating 565° C., the peak was 538 kg. In either case, the maximum load was greater than 535 kg for the casting sample that was solution heat treated at 500° C. in a conventinal manner.

EXAMPLE 9

Samples were cast from an aluminum alloy containing 6% Si and 3.5% Cu, as well as 0.3% Mg and 0.25% Fe impurities that was melted at 750° C. as in the prior art technique. The castings were subjected to T6 treatment under various conditions. A bending impact test was conducted with these samples to determine the impact value and maximum load bearing capacity of each sample as plotted against the duration of heating at temperatures exceeding the solidus temperature according to the present invention. A group of test samples having the same dimensions as those prepared in Example 8 were first heated at 540° C. for various periods, then left to cool to room temperature and again heated at 500° C. for 3 hours. Thereafter, the samples were aged at 160° C. for 5 hours. Another group of test samples were first heated at 555° C. for various periods and subsequently treated in the same manner. The sample which was first heated at 540° C. for 2 hours had an impact value of 0.45 kg·m/cm$^2$ and a maximum load bearing capacity of 657 kg. The sample which was first heated at 555° C. for 10 minutes had an impact value of 0.42 kg·m/cm$^2$ and a maximum load bearing capacity of 572 kg.

One sample was solution heat treated at 500° C. for 5 hours as in the conventional manner, and its impact value and maximum load bearing capacity were 0.23 kg·m/cm$^2$ and 585 kg, respectively.

EXAMPLE 10

An AC2B alloy containing 6% Si and 2% Cu, as well as 0.3% Mg and 0.25% Fe impurities was melted at 750° C., and poured into shell molds where it solidified in about 50 seconds. The so obtained casting samples were subjected to T6 treatment, wherein they were solution heat treated under various conditions and subsequently aged at 160° C. for 5 hours. The so treated samples were subjected to a bending impact test to determine the impact value and maximum load bearing capacity of each sample as plotted against the period of heating above the solidus temperature. The casting samples were not given any surface finishing for use as test pieces; they measured 10 mm×10 mm×55 mm and had a center notch in the form of a drilled hole of a diameter of 2 mm.

The final solidification temperature of the castings containing Mg and Fe as impurities was 507° C., and in order to avoid burning, they would usually not be solution heat treated at a temperature higher than about 500° C. The casting that was solution heat treated at 500° C. for 5 hours had an impact value of 0.28 kg·m/cm$^2$. The sample that was solution heat treated for 5 hours at 545° C. which was lower than the solidus temperature but higher than the final solidification point had an impact value of 0.56 kg·m/cm$^2$.

Figure 16:
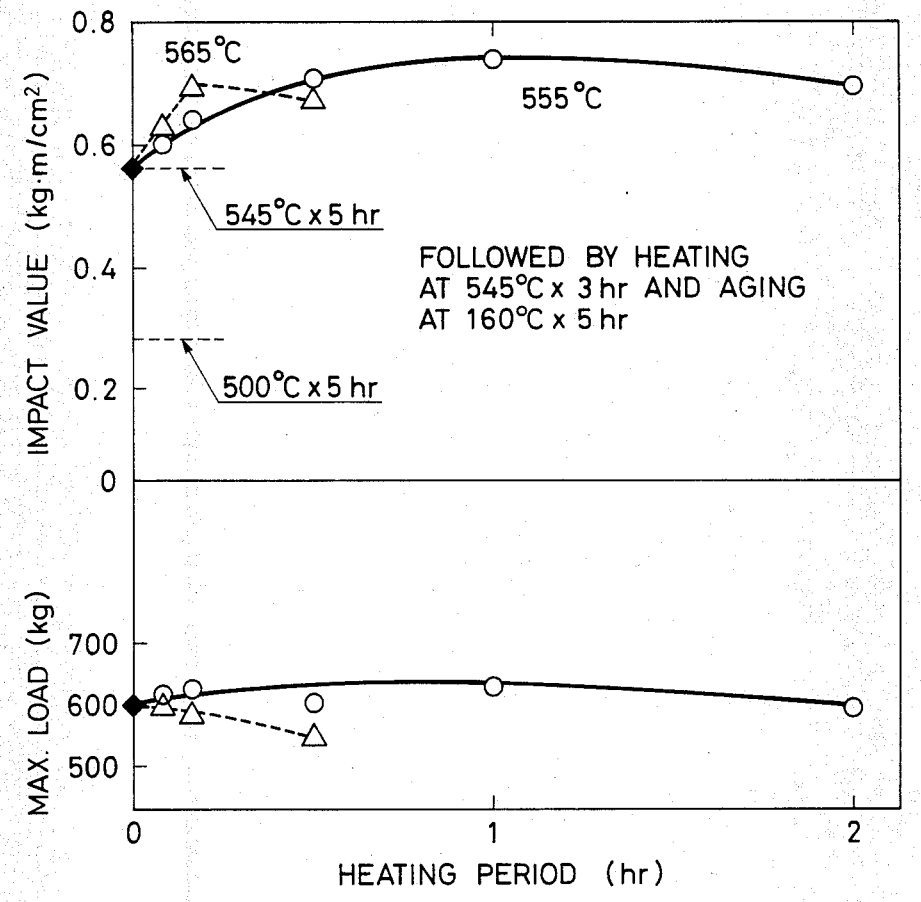
FIG. 16 is a graph showing the period of heating before solution heat treatment as against the impact value and maximum load bearing capacity of Al—6%-Si—2%Cu alloy castings.

The results of solution heat treatment according to the third aspect of the present invention are shown in FIG. 16. Casting samples were first heated for various times at 555° C. higher than the solidus temperature, then left to cool to room temperature, again heated at 545° C. for 3 hours, and aged at 160° C. for 5 hours. Also, samples were heated at 565° C. for various times and subsequently treated in a similar manner. As shown in FIG. 16, the sample that was first heated at 555° C. for one hour had an impact value of 0.74 kg·m/cm$^2$, and the one that was first heated at 565° C. for 10 minutes had an impact value of 0.70 kg·m/cm$^2$. A drop in the impact value was observed when the period of heating at 555° C. exceeded 1 hour. For heating at 565° C. a maximum impact value was obtained in a period of about 10 minutes, and a longer heating caused an appreciable drop in the impact value.

The peak of the maximum load that could be borne by the samples that were heated at 555° C. was 628 kg, and 600 kg for those which were heated at 565° C. In either case, the maximum load was greater than 535 kg, which could be applied to the sample that was solution heat treated at 500° C. in the conventional manner.

EXAMPLE 11

Figure 17A:
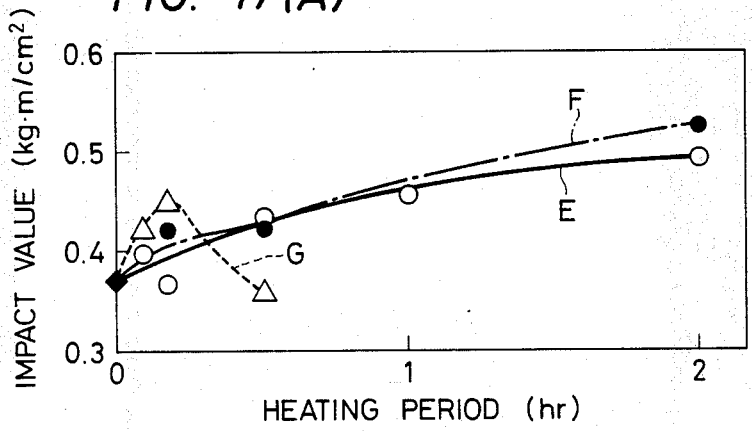
FIGS. 17(A) and 17(B) are graphs showing the period of heating before solution heat treatment as against the impact value and maximum load bearing capacity of Al—6% Si—3.5%Cu alloy castings.
Figure 17B:
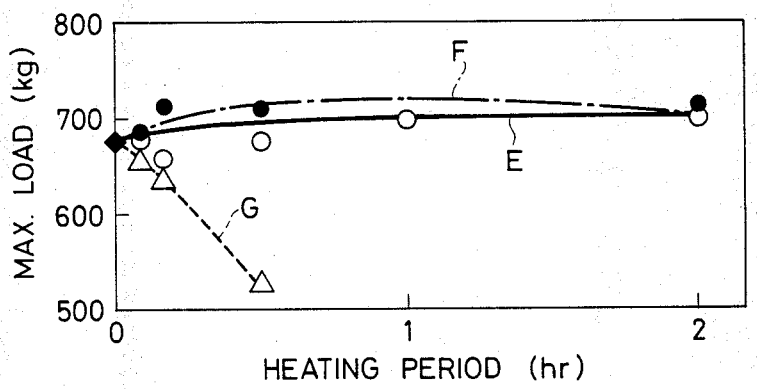

An AC2B alloy containing 6% Si, 3.5% Cu, as well as 0.3% Mg and 0.25% Fe impurities was melted at 750° C. as in the prior art technique, and poured into shell molds where it solidified in about 50 seconds. The so obtained casting samples were subjected to T6 treatment, wherein they were solution heat treated under various conditions and subsequently aged at 160° C. for 5 hours. The so treated casting samples were subjected to a bending impact test to determine the impact value and maximum load bearing capacity of each sample as plotted against the period of heating above the solidus temperature. The test results are shown in FIGS. 17(A) and 17(B).

A group of test samples having the same dimensions as those used in Example 8 were first heated at 540° C. for higher than the solidus temperature of the alloy, then left to cool to room temperature, again heated at 525° C. for 3 hours, and subsequently aged at 160° C. for 5 hours. The results with these samples are shown in FIG. 17 by the lines E connecting dots.

Another group of test pieces were first heated at 540° C., furnace cooled to 525° C. and held at that temperature for 3 hours, and subsequently aged at 160° C. for 5 hours. The results are shown by the curves F connecting solid dots.

The third group of samples were first heated at 560° C., left to cool to room temperature, again heated at 520° C. for 3 hours, and subsequently heated at 160° C. for 5 hours. The results are shown by the curves G connecting triangles.

Substantially the same results were obtained with the two groups of samples that were first heated at 540° C., one being later cooled to room temperature before another heating at 525° C. and the other being furnace cooled to 525° C. and held at that temperature for 3 hours. The samples first heated at 540° C. for 2 hours had impact values between 0.49 and 0.52 kg·m/cm$^2$, and both of them had a maximum load bearing capacity of about 700 kg. The sample that was first heated at 560° C. for 10 minutes had an impact value of 0.447 kg·m/cm$^2$ and the sample that was heated at 560° C. for 5 minutes had a maximum load bearing capacity of 652 kg.

The sample that was simply solution heat treated at 500° C. for 5 hours as in the prior art technique had an impact value of 0.229 kg·m/cm$^2$ and a maximum load bearing capacity of 583 kg.

EXAMPLE 12

An AC2B alloy containing 6% Si and 2% Cu, as well as 0.3% Mg and 0.25% Fe impurities was melted at 850° C., and poured into shell molds where it solidified in about 50 seconds. The so obtained casting samples were subjected to T6 treatment, wherein they were solution heat treated under various conditions and subsequently aged at 160° C. for 5 hours. The so treated samples were subjected to a bending impact test to determine the impact value and maximum load bearing capacity of each sample as plotted against the period of heating above the solidus temperature. The casting samples were not given any surface finishing for use as test pieces; they measured 10 mm×10 mm×55 mm and had a center notch in the form of a drilled hole of a diameter of 2 mm.

The final solidification temperature of the castings containing Mg and Fe as impurities was 507° C., and in order to avoid burning, they would usually not be solution heat treated at temperatures higher than about 500° C. The casting that was solution heat treated at 500° C. for 5 hours had an impact value of 0.43 kg·m/cm$^2$. The sample that was solution heat treated for 5 hours at 545° C., which was lower than the solidus temperature but higher than the final solidification point, had an impact value of 0.92 kg·m/cm$^2$.

Figure 18A:
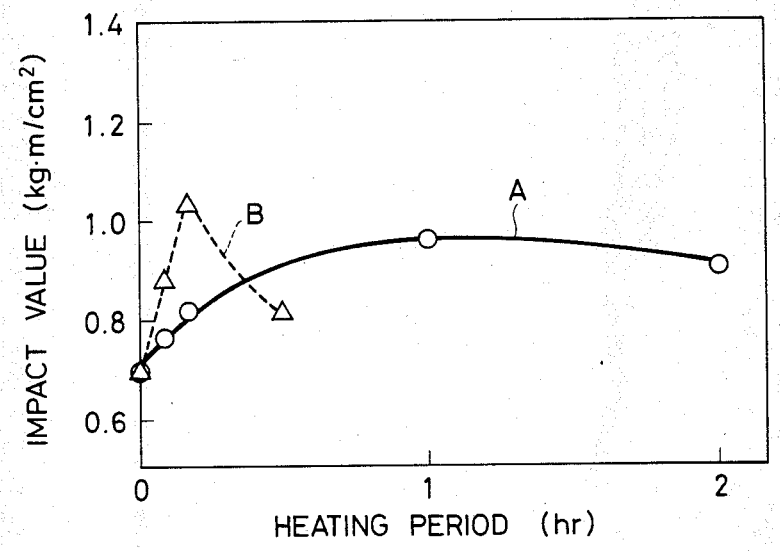
FIGS. 18(A) and 18(B) are graphs showing the period of heating before solution heat treatment as against the impact value and maximum load bearing capacity of Al—6% Si—2%Cu alloy castings.
Figure 18B:
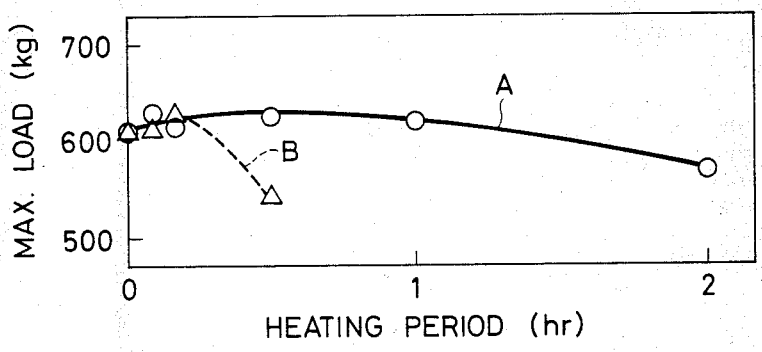

The results with the test pieces that were given solution heat treatment according to the third aspect of the present invention are shown in FIGS. 18(A) and 18(B). A group of test samples were first heated at 555° C. (higher than the solidus temperature), then left to cool to room temperature, again heated at 545° C. for 3 hours and subsequently aged at 160° C. for 5 hours. The test data with these samples is indicated in FIGS. 18(A) and 18(B) by the curves A connecting open dots. Another group of test pieces were first heated at 565° C., and subsequently treated as above. The results are shown by the curves B connecting triangles.

As shown in FIGS. 18(A) and 18(B), the sample that was first heated at 555° C. for 1 hour had an impact value of 0.96 kg·m/cm$^2$. The sample that was heated at 565° C. for 10 minutes had an impact value of 1.03 kg·m/cm$^2$. A drop in the impact value occurred when the period of heating at 555° C. exceeded 1 hour. For heating at 565° C., a maximum impact value was obtained in about 10 minutes, and a longer heating caused an appreciable drop in the impact value.

For heating at 555° C., a peak of the maximum load bearing capacity was 628 kg, whereas for heating at 565° C., the peak was also 628 kg. In either case, the maximum load was greater than 540 kg for the casting sample that was solution heat treated at 500° C. in the conventional manner.

EXAMPLE 13

Figure 19A:
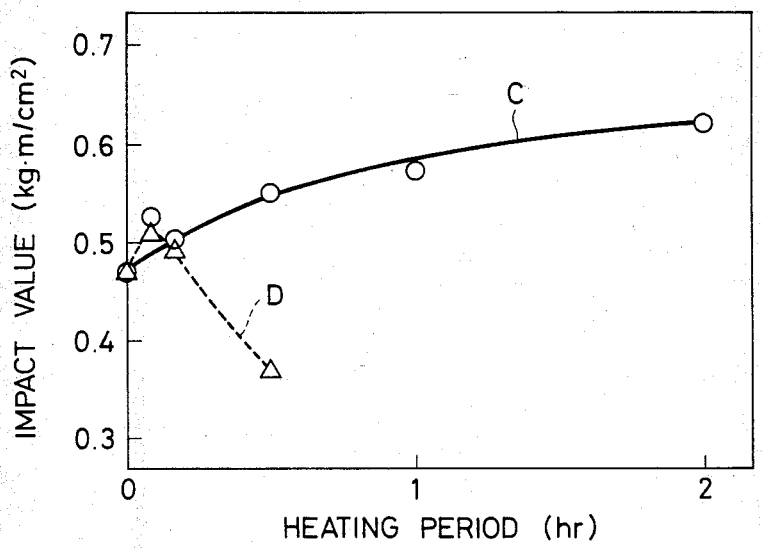
FIGS. 19(A) and 19(B) are graphs showing the period of heating before solution heat treatment as against the impact value and maximum load bearing capacity of Al—6%—4.5%Cu alloy castings.
Figure 19B:
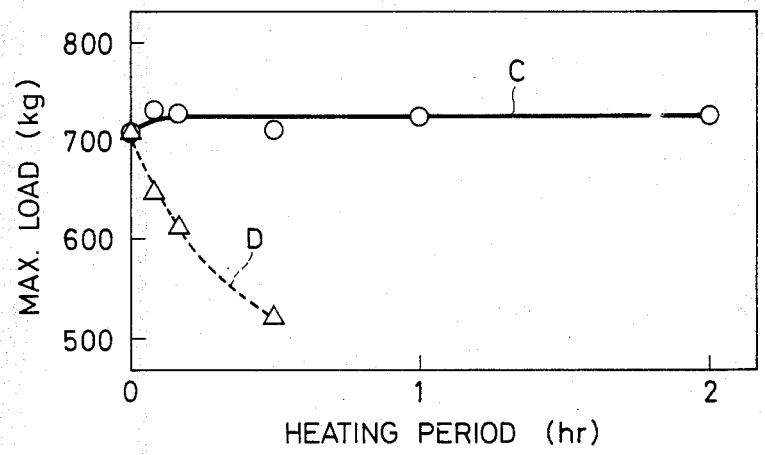

Samples were cast from an aluminum alloy containing 6% Si, 4.5% Cu, as well as 0.3% Mg and 0.25% Fe impurities. The castings were subjected to T6 treatment under various conditions. A bending impact test was conducted with these samples to determine the impact value and maximum load bearing capacity of each sample as plotted against the period of heating above the solidus temperature. The results are shown in FIGS. 19(A) and 19(B). A group of test pieces having the same dimentions as those prepared in Example 8 were first heated for various periods at 530° C. which was higher than the solidus temperature of the alloy, then left to cool to room temperature, again heated at 520° C. for 3 hours, and subsequently aged at 160° C. for 5 hours. The test results with these samples are indicated in FIGS. 19 (A) and 19(B) by the curves C connecting open dots. Another group of test pieces were first heated at 555° C. and subsequently treated as above. The data for these samples is shown by the curves D connecting triangles.

As is clear from FIGS. 19(A) and 19(B), the sample that was first heated at 530° C. for 2 hours had an impact value of 0.61 kg·m/cm$^2$ and a maximum load bearing capacity of about 727 kg. The sample that was heated at 555° C. for 5 minutes had an impact value of 0.51 kg·m/cm$^2$ and a maximum load bearing capacity of 652 kg.

One sample was solution heat treated at 500° C. for 5 hours as in the conventional manner, and its impact value and maximum load bearing capacity were 0.344 kg·m/cm$^2$ and 655 kg, respectively.

We claim:

1. A process for producing an aluminum alloy casting comprising the following steps:

melting an Al—Si or Al—Si—Cu alloy containing 4 to 24 wt % of silicon, iron and other incidental impurities, the balance being aluminum;

heating the melt at a temperature between 825° C. and 950° C; and pouring the melt into a mold and solidfying the melt.

2. The process according to claim 1, which further comprises the steps of solution heat treatment and aging.

3. The process according to claim 1, wherein said alloy contains 0.25 to 1.4 wt % of iron.

4. A process for producing an aluminum alloy casting comprising the following steps:

melting an Al—Si—Cu alloy containing 4to 24 wt % of silicon, iron and other incidental impurities, the balance being aluminum;

pouring the melt into a mold and solidifying the melt;

solution heat treating the casting at a temperature not lower than the ternary eutectic temperature in the equilibrium state but not higher than the solidus temperature in the equilibrium state; and aging the thus-treated casting.

5. The process according to claim 4, wherein the alloy consists essentially of 6 to 12 wt % Si, 2 wt % Cu, 0.2 to 0.4 wt % Mg and other incidental impurities, the balance being aluminum, said alloy being solution heat treated by heating at between 525° C. and 545° C. for a period of 1 to 5 hours.

6. A process for producing an aluminum alloy casting which comprises the following steps:

melting an Al—Si—Cu alloy containing 4 to 24 wt % of silicon, iron. and other incidental impurities, the balance being aluminum;

pouring the melt into a mold and solidifying the melt;

solution heat treating the casting by first heating the casting at a temperature not lower than the solidus temperature of said alloy in its equilibrium state, then cooling the casting to a temperature lower than said solidus temperature but not lower than the solvus, and finally holding the casting at the latter temperature; and aging the thus-treated casting.

7. The process according to claim 6, wherein said alloy consists essentially of 6 to 12 wt % Si, 2 wt % Cu, 0.2 to 0.4 wt % Mg and other incidental impurities, the balance being aluminum, said alloy being solution heat treated by first heating the alloy at between 545° C. and 555° C. for a period of 1 to 2 hours, cooling the alloy to a temperature between 525° C. and 545° C. and holding the cooled alloy at that temperature.

8. The process according to claim 4, wherein said melting stepis followed by a step of heating the melt at a temperature between 780° C. and 950° C.

9. The process according to claim 6, wherein said melting step is followed by a step of heating the melt at a temperature between 780° C. and 950° C.

10. An aluminum alloy casting consisting essentially of: (a) 4 to 24 wt % Si, 0.25 to 1.4 wt % Fe or 4 to 24 wt % Si, 0.25 to 1.4 wt % Fe, Cu, and (b) other incidental impurities except for manganese, the balance being aluminum, an iron compound being crystallized as irregular particles or as fine needles wherein the aluminum alloy casting is produced by a process comprising the following steps:

melting an Al—Si or Al—Si—Cu alloy containing 4 to 24 wt % of silicon, 0.25 to 1.4 wt % ofiron and other incidental impurities, the balance being aluminum;

heating the melt at a temperature between 825° C. and 950° C.; and pouring the melt into a mold and solidifying the melt.

11. An aluminum alloy casting consisting essentially of 6 to 12 wt % Si, 2 to 4.5 wt % Cu, not more than 0.4 wt % of Mg and other incidental impurities, the balance being aluminum, the putting of the solute elements into solution in a matrix and the spheroidization of silicon particles being promoted simultaneously by solution heat treating the casting at a temperature not lower than the ternary eutectic temperature in the equilibrium state but not higher than the solidus temperature of said alloy in the equilibrium state.

12. An aluminum alloy casting consisting essentially of 6 to 12 wt % Si, 2 to 4.5 wt % Cu, not more than 0.4 wt % of Mg and other incidental impurities, the balance being aluminum, the putting of the solute elements into solution in a matrix, the spheroidization of silicon particles and the formation of particles of an iron compound near the ternary eutectic being promoted simultaneously by solution heat treatment of the casting which comprises first heating the same at a temperature not lower than the solidus temperature of the alloy in its equilibrium state and then holding said casting at a temperature below the solidus temperature but not lower than the solvus of the alloy.

13. The aluminum alloy casting according to claim 11, wherein an iron compound is crystallized as irregular-shaped particles or as fine needles.

14. The aluminum alloy casting according to claim 12 wherein an iron compound is crystallized as irregular-shaped particles or as fine needles.

* * * * *